US005868157A

United States Patent [19]

Yoshimura et al.

[11] Patent Number: 5,868,157

[45] Date of Patent: Feb. 9, 1999

[54] PILOT TRANSFER VALVE

[75] Inventors: Shinichi Yoshimura; Makoto Ishikawa, both of Yawara-mura, Japan

[73] Assignee: SMC Corporation, Tokyo, Japan

[21] Appl. No.: 969,938

[22] Filed: Nov. 25, 1997

[30] Foreign Application Priority Data

Dec. 5, 1996 [JP] Japan ..... 8-340478

[51] Int. Cl.[6] ..... F15B 13/043

[52] U.S. Cl. ..... 137/269; 137/625.64; 251/26

[58] Field of Search ..... 137/269, 625.64; 251/26

[56] References Cited

U.S. PATENT DOCUMENTS 4,706,930 11/1987 Lexen ..... 251/26
4,966,196 10/1990 Meyer ..... 137/625.64

FOREIGN PATENT DOCUMENTS 2 257 837 8/1975 France .
2 495 269 6/1992 France .
1 127 675 4/1962 Germany .
64-17078 1/1989 Japan .
1-163270 11/1989 Japan .
1-174684 12/1989 Japan .
2 055 977 3/1981 United Kingdom .

*Primary Examiner*—Gerald A. Michalsky
*Attorney, Agent, or Firm*—Oblon, Spivak, McClelland, Maier & Neustadt, P.C.

[57] ABSTRACT

A transfer valve according to this invention has an internal pilot channel in communication with a supply port; an external pilot channel in communication with an external pilot port; a shuttle valve that selectively guides pilot fluid from the internal and external pilot channels to a pilot valve. The shuttle valve has two inlets, one outlet and a shuttle valve member that always connects the inlet on the high pressure side to the outlet while closing the inlet on the low pressure side, wherein the two inlets are individually connected to the internal and external pilot channels while the outlet is connected to the pilot valve.

7 Claims, 4 Drawing Sheets

PILOT TRANSFER VALVE

FIELD OF THE INVENTION

The present invention relates to a pilot transfer valve that switches a valve member using pilot fluid; in particular, to a pilot transfer valve that can be used as both internal and external pilot types.

PRIOR ART

Pilot transfer valves are one kind of transfer valve used for switching the flow of pressurized fluid, such as compressed air. The pilot transfer valve is composed of a main valve and pilot valve to switch a valve member in the main valve by causing the pressure of pilot fluid supplied from the pilot valve to act on the valve member.

The pilot transfer valves can be classified into internal and external types depending on the method used to supply the pilot fluid. The internal pilot transfer valve guides, as pilot fluid, part of a main fluid from a supply port in the main valve to the pilot valve, while the external pilot type guides pilot fluid separate from the main fluid, to the pilot valve through external piping connected to the pilot valve. Different transfer valves are used under different operating conditions, but the internal pilot type must often be converted into the external pilot type, or the reverse, depending on changes in the operating conditions.

For such cases, transfer valves that can be converted between use as internal and external pilot types have previously been proposed, for example, in Japanese Utility Model Laid Open No. 64-17078, Japanese Utility Model Laid Open No. 1-162370, and Japanese Utility Model Laid Open No. 1-174684.

All conventional transfer valves, however, are switched between internal and external use by manual installation, removal and replacement of parts. Thus, the switching operation is cumbersome and requires considerable time and labor if a large number of transfer valves need to be converted; and checking all transfer valves for correct switching also requires considerable time and labor. Repeated conversions are also likely to cause mishandling of the valves.

DISCLOSURE OF THE INVENTION

One object of this invention to provide a pilot transfer valve that can automatically and reliably be switched between use as internal and external pilots.

Another object of this invention is to prevent retention of pilot fluid inside the pilot transfer valve while changing between the internal and external pilot types, in order to eliminate the pressure effects of the remaining pilot fluid.

To achieve these goals, this invention provides a pilot transfer valve that has an internal pilot channel in communication with a supply port, an external pilot channel in communication with an external pilot port and a shuttle valve that selectively guides pilot fluid from the internal and external pilot channels to the pilot valve.

The shuttle valve has two inlets, one outlet and a shuttle valve member operated by the pressure of fluid flowing in from the inlets to always connect the inlet on the high pressure side to the outlet while closing the inlet on the low pressure side, wherein the two inlets are individually connected to the internal pilot channel while the outlet is connected to the pilot valve.

In the transfer valve in the above configuration according to this invention, pilot fluid is always supplied through the internal pilot channel to one of the inlets of the shuttle valve from the main valve supply port. When no pilot fluid is supplied to the external pilot port, the shuttle member opens the inlet under a higher pressure that leads to the internal pilot channel, thus connecting the inlet to the outlet, while closing the other inlet leading to the external pilot channel. Thus, pilot fluid is supplied to the pilot valve through the internal pilot channel to allow the transfer valve to operate as an internal type. On the other hand, when pilot fluid is supplied to the external pilot port from the exterior under pressure higher than the main fluid, the shuttle valve member is switched to the opposite position to connect the outlet to the inlet under higher pressure that leads to the external pilot channel, while closing the other inlet under lower pressure that leads to the external pilot channel. Thus, the pilot fluid is supplied to the pilot valve through the external pilot channel to allow the transfer valve to operate as an external pilot type.

In this manner, the transfer valve can be automatically converted between use as internal and external types simply by determining whether pilot fluid is to be supplied through the external pilot port.

According to a specific embodiment of this invention, the pilot valve is mounted in the valve body of the main valve via an adapter plate, with the shuttle valve incorporated into the adapter plate.

According to this invention, the transfer valve can be configured as either 3- or 5-port type.

By configuring the transfer valve according to this invention as a 5-port type in which one of the first, fourth or fifth ports is connected to the internal pilot channel, the transfer valve can be used as either a central supply type that uses the first port at the center as the supply port, or a both-end supply type that uses the fourth and fifth ports at either end as the supply port.

As a specific example of this configuration, a switching mechanism for the pilot channel consists of two shuttle valves referred to as second and third shuttle valves, wherein two inlets of the second shuttle valve are connected to the first and fifth ports, while an outlet of the second shuttle valve is connected to one of the two inlets of the third shuttle valve, with the other inlet of the third shuttle valve connected to the fourth port and with an outlet of the third shuttle connected to the internal pilot channel.

DETAILED DESCRIPTION

Figure 1:
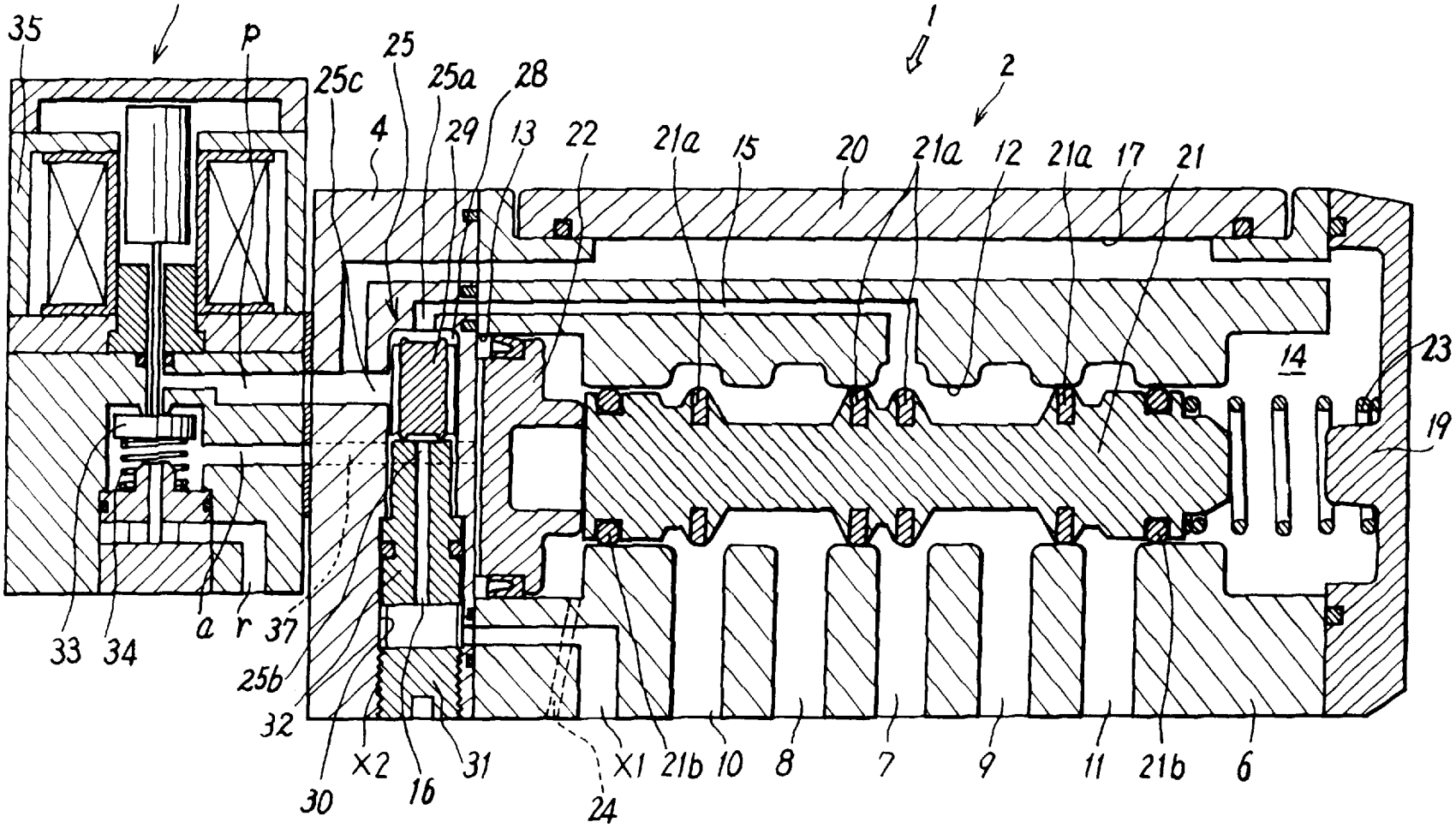
FIG. 1 is a cross-sectional view of a first embodiment according to this invention.

FIG. 1 shows a transfer valve 1A of a single pilot type comprising a main valve 2 and a solenoid- driven pilot valve 3 and configured to be installed on a manifold base.

The valve body of the main valve 2 is a rectangular parallelopiped that has on its bottom surface a supply port 7 at its center, output ports 8, 9 on either side of the supply port, ejection ports 10, 11 on either side of the output ports 8, 9 and an external pilot port X1 in such a way that the ports are sequentially disposed at equal intervals in the longitudinal direction. A valve hole 12 in to which ports 7 to 11 are each opened is formed inside a valve body 6 in the axial direction, and a main valve member 21 for switching the channel among the ports slides into the valve hole 12.

Seal rings 21*a*, 21*a*, which enable and disable communication between adjacent ports and O rings 21*b*, 21*b* sealing between one of the ejection ports 10 and a piston chamber 13 and between the other ejection port 11 and a return chamber 14 are fitted in grooves formed in the outer circumferential surface of the main valve member 21.

Piston chamber 13 is formed at one end of valve hole 12 between the valve body and an adapter plate 4 that is part of the main valve 2, with a piston 22 of a larger diameter than the main valve member 21 sliding into the piston chamber 13. The chamber behind a piston chamber 22 is a breather hole 23 open to the exterior. The return chamber 14 is formed at the other of the valve hole 12 between the valve body and an end plate 19, and a return spring 23 of relatively small force is installed in the return chamber 14, between the end plate 19 and the main valve member 21, so that it is slightly compressed.

A shuttle valve 25 that selectively supplies pilot fluid to the pilot valve 3 from either the supply port 7 or the external pilot port X1 is incorporated inside the adapter plate 4.

The shuttle valve 25 has two inlets 25*a*, 25*b* opening into a valve chamber 28 at opposite positions, an outlet 25*c* opening into the chamber 28 between the inlets 25*a*, 25*b*, and a shuttle valve member 29 accommodated in the valve chamber 28 and operated by fluid pressure from fluid flowing in from the two inlets 25*a*, 25*b* to always connect the inlet under higher pressure to the outlet while closing the inlet under a lower pressure. One of the inlets 25*a*, 25*b* is connected to the supply port 7 through an internal pilot channel 15, while the other inlet 25*b* is connected to the external pilot port X1 through an external pilot channel 16, with the output 25*c* connected to a pilot supply opening (p) in the pilot valve 3.

The "outlet" does not necessarily refer to one outlet opened at one point of a valve chamber 28 but includes a number of outlets opened at the respective points of the valve chamber 28 and commonly in communication with the pilot supply port (p).

The valve chamber 28 in the shuttle valve 25 is formed between the interior end of a staged hole formed from the bottom surface of the adapter plate 4 and the tip of a channel member 32, by inserting the channel member 32 into a hole 30. The channel member 32 is fixed to the hole 30 by a plug 31, screwed at the opening of the hole 30. The opening of the hole 30 is also used as an external pilot port X2 by removing the plug 31.

A pilot communication passage 17 allowing an outlet 25*c* of the shuttle valve 25 to communicate with the return chamber 14 is formed in the main valve 2. Part of the communication passage 17 is formed by cutting a depression in the top surface of the valve body 6 and covering the depression with a top cover 20.

The pilot valve 3 is configured as a normal- closed 3-port solenoid valve and includes the pilot supply port (p);

a pilot output opening (a); a pilot ejection opening (r); a pilot valve member 33 that allows the pilot output opening (a) to communicate with the pilot supply or ejection opening (p) or (r); and a return spring 34 that presses a pilot valve member 33 in the direction in which the pilot supply opening (p) is closed. When a solenoid 35 is energized, the pilot valve member 33 allows the pilot supply opening (p) to communicate with the pilot output opening (a). When the solenoid is de-energized, the return spring 34 forces the pilot valve member 33 to return to the state illustrated, thereby allowing the pilot output opening (a) to communicate with the pilot ejection port (r).

The transfer valve 1A of the above configuration acts as an internal pilot when pilot fluid is not supplied from the external pilot port X1 to the pilot valve 3 and as an external pilot when pilot fluid is supplied from the external pilot port X1.

Since pilot fluid is always supplied from the supply port 7 in the main valve 2 through an internal pilot channel 15 to one of the inlets 25*a* of the shuttle valve 25, when no pilot fluid is supplied to the external pilot port X1 from the exterior, a shuttle valve member 29 opens the inlet 25*a* under a higher pressure that leads to the internal pilot channel 15 in order to connect the inlet to outlet 25*c*, while closing the other inlet 25*b* leading to an external pilot channel 16. Thus, pilot fluid is supplied to the pilot valve 3 through the internal pilot channel 15 to allow the transfer valve 1A to operate as an internal pilot.

But when pilot fluid at a pressure higher than the main fluid is supplied from the exterior to the external pilot port X1, the shuttle valve member 29 is switched to the position opposite to that described above to connect the inlet 25*b* to the outlet 25*c* under a higher pressure that leads to an external pilot channel 16 while closing the inlet 25*a* under a lower pressure that leads to the internal pilot channel 15.

In this manner, the transfer valve 1A can be automatically converted between the internal and external use simply by determining whether pilot fluid is to be supplied through the external pilot port.

Whether serving as an internal or external pilot, the transfer valve 1A operates as follows. When the solenoid 35 is de-energized, as shown in the figure, the acting force of pilot fluid supplied to the return chamber 14 and pressure from the return spring 23 cause the main valve member 21 to be placed at a first switching position. At this point, supply and output ports 7 and 9 communicate with each other, the output and ejection ports 8 and 10 communicate with each other, and an ejection port 11 is shut off from the other ports, so that pressurized fluid is output from the output port 9.

When the solenoid 35 is energized, pilot fluid is supplied to the piston chamber 13 in the main valve 2 from the pilot supply opening (p) through the pilot output opening (a) and a pilot output channel 37, causing the piston 22 to move the main valve member 21 to the right in the figure to occupy a second switching position. Consequently, the supply and output ports 7 and 8 communicate with each other, the output and the ejection port 9 and 11 communicate with each other, and the ejection port 10 is shut off from the other ports, so that the pressurized fluid is output from the output port 8.

When the solenoid 35 is then de-energized, the pilot fluid in the piston chamber 13 is ejected from the piston ejection opening (r) through the pilot output channel 37, so that the pilot fluid supplied to the return chamber 14 and the return spring 23 presses and the return main valve member 21 to the first switching position, together with the piston 22.

In addition, when the supply and external pilot ports 7 and X1 are opened to the exterior, the pilot channel is cleared of any remaining fluid contained within the shuttle valve 25 or any of the channels. As a result, the transfer valve is unaffected by the remaining pressure even if a source of another at a different pressure is connected to the transfer valve.

Figure 2:
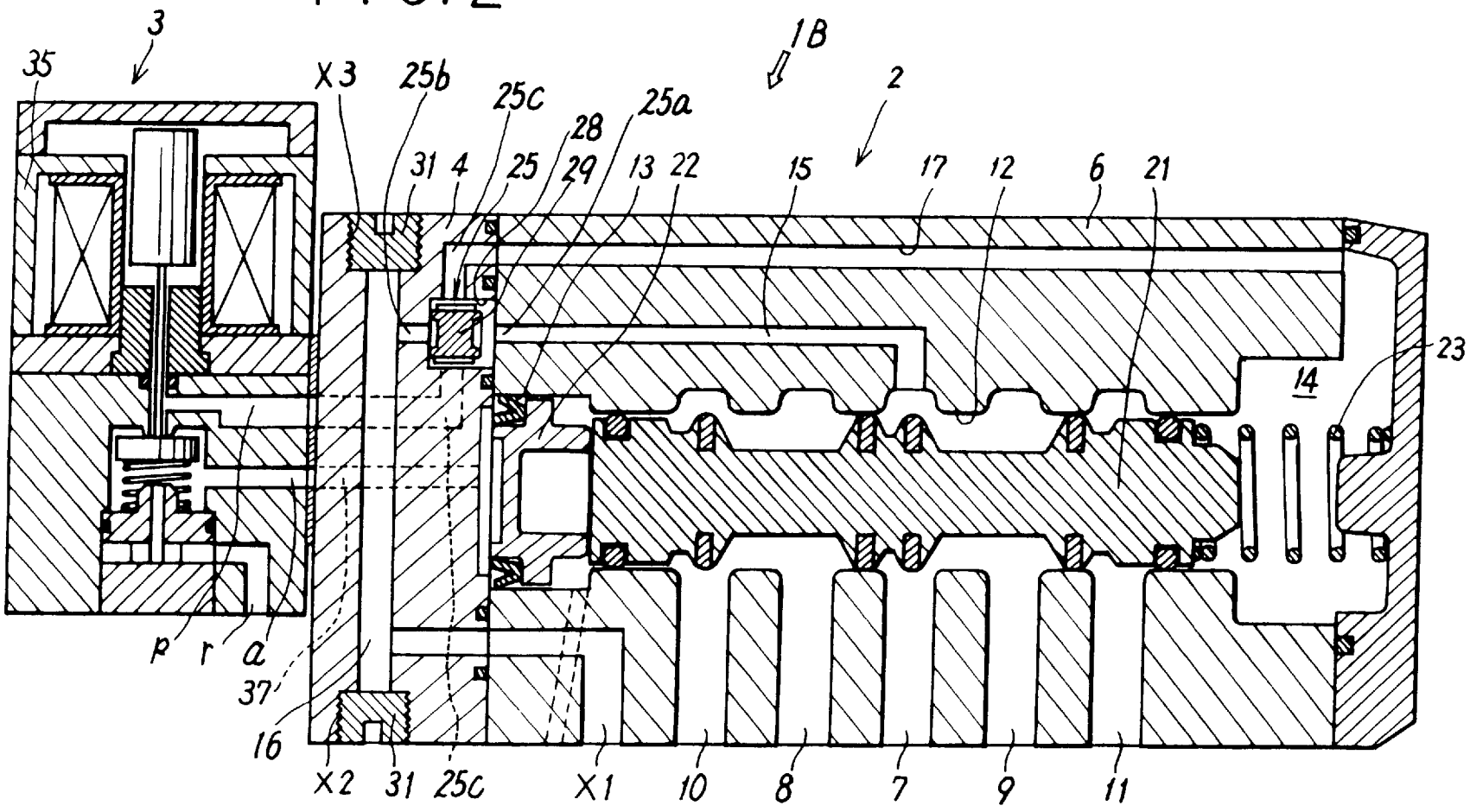
FIG. 2 is a cross-sectional view of a second embodiment according to this invention.

FIG. 2 shows a second embodiment of this invention, wherein the major difference between the transfer valve 1A and a transfer valve 1B is the structure of adapter plate 4.

In the adapter plate 4, the valve chamber 28 in the shuttle valve 25 is formed of a depression cut from the valve body 6 side of the main valve, and the shuttle valve member 29 is accommodated within the valve chamber 28 as shown in the figure. In addition, the external pilot channel 16 formed in the adapter plate 4 penetrates it vertically and communicates with one of the inlets 25*b* of the shuttle valve 25 and with the external pilot port X1 formed in the valve body 6.

Both ends of the external pilot channel 16 are auxiliary external pilot ports X2, X3, which are closed by the plug 31 and can be used as ports by removing the plug 31. Thus, the pilot valve X2 or X3 can be used even if the external pilot port X1 cannot, due to the installation site or position of the transfer valve 1B.

In addition, the outlet 25*c* of the shuttle valve 25 is opened at two points of the valve chamber 28, with one of the openings in communication with the return chamber 14 through a pilot communication passage 17, which penetrates the valve body, and with the other in communication with the pilot supply port (p).

Other configuration and operation details of this second embodiment are identical to the first embodiment, and matching components have the same reference numerals as in the first embodiment. Their description is omitted.

Figure 3:
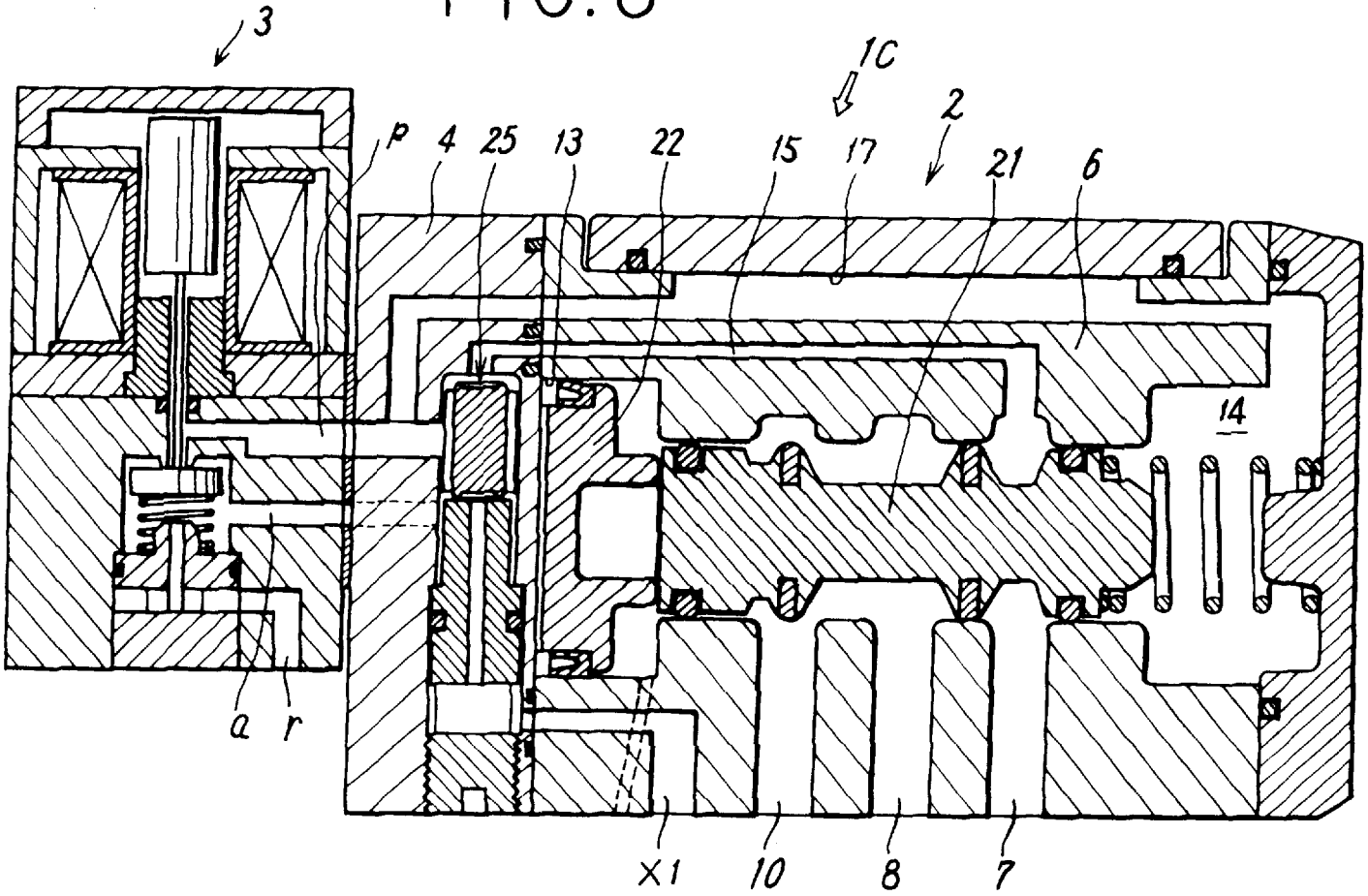
FIG. 3 is a cross-sectional view of a third embodiment according to this invention.

Although the transfer valves according to the first and second embodiments are each of a 5-port type, the transfer valve according to this invention is not limited to the 5-port type but may be a 3- port transfer valve. FIG. 3 shows a 3-port transfer valve 1C, the third embodiment of this invention. Since the transfer port 1C has the same configuration and operation details as the first embodiment, except for having the supply port 7, one output port 8 and one ejection port 10, matching components have the same reference numerals as in the first embodiment. Their description is omitted.

Figure 4:
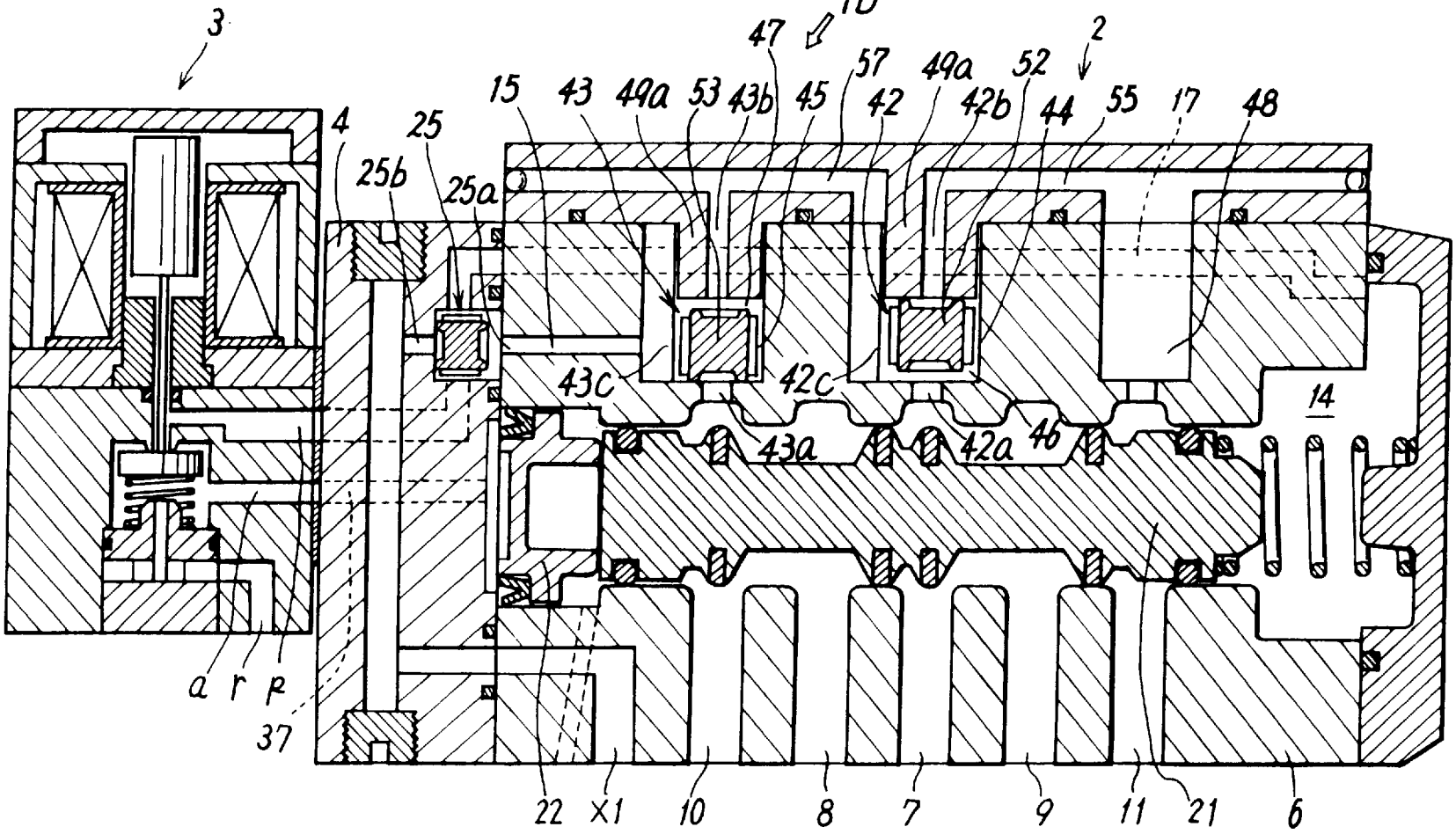
FIG. 4 is a cross-sectional view of a fourth embodiment according to this invention.

FIG. 4 shows a fourth embodiment. A transfer valve 1D according to the fourth embodiment is of the 5-port type and is characterized by the same basic configuration as in the second embodiment, except that the supply and ejection port functions can be exchanged. The difference from the second embodiment is described below.

The transfer valve 1D has a first port 7 at its center, a second and third ports 2 and 3 on either side of the first port and a fourth and fifth ports 10 and 11 on either side of the second and third ports. The valve body 6 has a pilot channel switching mechanism for connecting to the internal pilot channel either the first port 7 or the fourth and fifth ports 10, 11 connected to a supply source for pressurized fluid.

The pilot channel switching mechanism is composed of a second shuttle valve 42 and a third shuttle valve 43. Valve chambers 44, 45 in the shuttle valves 42, 43 are formed between recessed portions 46, 47 cut from the top surface at the positions corresponding to the first and fourth ports 7 and 10 in the valve body 6 and protruding portions 49*a* provided on a top cover 49 fixed to the top surface of the body 6 and fitted in the recessed portions 46, 47 and have shuttle valve members 52, 53 accommodated in the valve chambers 44, 45. One 42*a* of inlets 42*a*, 42*b* of the second shuttle valve 42 is in communication with the first port 7, while the other inlet 42*b* is in communication with the fifth port 11 through a passage 55 formed in the top cover 49 and a recessed portion 48 and a through hole 56 formed in valve body 6. An output 42*c* is in communication with one 43*b* of two inlets 43*a*, 43*b* of the third shuttle valve 43 through a passage 57 in the valve body 6 and the top cover 49. In addition, the other inlet 43*a* of the third shuttle valve is in communication with the fourth port 10 and an outlet 43*c* is in communication with the internal pilot channel 15.

When the first port 7 is connected to a supply source of pressurized fluid, the transfer valve according to the fourth embodiment acts as a central supply type that use the first port 7 as a supply port. In this case, the second and third ports 8 and 9 operate as output ports while the fourth and fifth ports 10 and 11 operate as ejection ports. In addition, pressurized fluid from the first port 7 switches the shuttle valve members 52, 53 in the second and third shuttle valves 42, 43 to the position in FIG. 4 and is supplied to one of the inlets 25*a* of the first shuttle valve 25 through the internal pilot channel 15.

When no external pilot fluid is supplied from the external pilot port X1, pressurized fluid from the first port 7 switches the valve member 29 in the first shuttle valve 25 to the illustrated position and is supplied to the pilot valve 3 and the return chamber 14. Thus, the transfer valve 1D acts as an internal pilot.

When pilot fluid at a pressure higher than the main fluid is introduced from the external pilot port X1, the valve member 29 in the first shuttle valve 25 is switched to a position opposite that shown in the figure, and this external pilot fluid is supplied to the pilot valve 3 and the return chamber 14. Thus, the transfer valve acts as an external pilot.

But when the fourth and fifth ports 10 and 11 are connected to a supply source of pressurized fluid, the transfer valve operates as a both-end supply type that uses the ports 10, 11 as supply ports. In this case, the second and third ports 8 and 9 are used as output ports, and the first port is used as an ejection port.

Pressurized fluid from the fifth port 11 switches the shuttle valve member 52 in the second shuttle valve 42 to the position opposite that in FIG. 4 and flows to one of the inlets 43*b* of the third shuttle valve 43 from the outlet 42*c* through the through hole, while pressurized fluid from the fourth port 10 is supplied to the other inlet 43a of the third shuttle valve 43. In the third shuttle valve 43, one of the pressurized fluids supplied to the inlets 43*a*, 43*b* from the fourth and fifth ports 10 and 11, respectively, that is at a higher pressure is supplied to the pilot valve 3 through the internal pilot channel 15. If the two pressurized fluids are at the same pressure, the two inlets 43*a*, 43*b* are both connected to the outlet 43*c*.

This transfer valve of the both-end supply type operates as an internal pilot if no external pilot fluid is supplied from the external pilot port X1, whereas it operates as an external pilot type if an external pilot fluid under a higher pressure is supplied from the external pilot port X1.

Although the basic configuration of the fourth embodiment shown in FIG. 4 is the same as that of the second embodiment except for the configuration associated with the pilot fluid switching mechanism, the fourth embodiment may of course be configured as with the first embodiment.

In addition, although the illustrated embodiments show single-solenoid transfer valves, they may be converted into a double-solenoid types by providing a return means consisting of the adapter plate 4 incorporating the piston 22 and the shuttle valve 25 and the pilot valve 3 instead of a return means consisting of the return chamber 14 and return spring 23.

What is claimed is:

1. A pilot transfer valve including a main valve having one supply port, at least one output port, at least one ejection port, a valve hole in communication with these ports and a main valve member capable of moving in the valve hole to switch the channels; and at least one pilot valve that supplies pilot fluid to the main valve to drive said main valve member, wherein said main valve has an internal pilot channel in communication with said supply port, an external pilot port that introduces pilot fluid from the exterior, an external pilot channel in communication with the external pilot port and a shuttle valve that selectively guides pilot fluid from either the internal or external pilot channel to the pilot valve, wherein said shuttle valve has two inlets, one outlet, a valve chamber into which the inlets and outlet are opened and a shuttle valve member accommodated in the valve chamber and operated by means of pressure from fluid flowing in from said inlets to always connect the inlet on the high pressure side to the outlet while closing the inlet on the low pressure side and wherein the two inlets are individually connected to said internal and external pilot channels while the outlet is connected to the pilot valve.

2. A transfer valve according to claim 1 wherein said pilot valve is mounted in the valve body of the main valve via an adapter plate and wherein said shuttle valve is built into the adapter plate.

3. A transfer valve according to claim 1 or 2 wherein the transfer valve is a 3-port valve having one supply port, one output port and one ejection port.

4. A transfer valve according to claim 1 or 2 wherein the transfer valve is a 5-port valve having one supply port, two output ports and two ejection ports.

5. A pilot transfer valve including a main valve having a first port for supplying or ejecting a pressurized fluid, a second and third ports for output, a fourth and fifth ports for ejection or supply, a valve hole in communication with these ports and a main valve member in the valve hole capable of moving to switch channels; and at least one pilot valve that supplies pilot fluid to the main valve to drive said main valve member, wherein said main valve has an internal pilot selectively connected to the first, fourth, or fifth port by a pilot channel switching mechanism, an external pilot port that introduces pilot fluid from the exterior, an external pilot channel in communication with the external pilot port and a first shuttle valve that selectively guides pilot fluid from either the internal or external pilot channel to the pilot valve, wherein said first shuttle valve has two inlets, one outlet, a valve chamber into which the inlets and outlet are opened and a shuttle valve member accommodated in the valve chamber and operated by pressure from fluid flowing in from said inlets to always connect the inlet on the high pressure side to the outlet while closing the inlet on the low pressure side and wherein the two inlets are individually connected to said internal and external pilot channels while the outlet is connected to the pilot valve.

6. A transfer valve according to claim 5 wherein said pilot channel switching mechanism comprises two shuttle valves including a second and third shuttle valves, wherein the shuttle valves each have two inlets, one outlet, a valve chamber into which the inlets and outlet are opened and a shuttle valve member accommodated in the valve chamber and operated by pressure from a fluid flowing in from said inlets to always connect the inlet on the high pressure side to the outlet while closing the inlet on the low pressure side, and wherein two inlets of the second shuttle valve are individually connected to said first and fifth ports, with the outlet connected to one of the two inlets of the third shuttle valve, while the other inlet of the third shuttle valve is connected to the fourth port, with the outlet connected to said internal pilot channel.

7. Transfer valve according to claim 6 wherein said pilot valve is mounted in the valve body of the main valve via an adapter plate, wherein said first shuttle valve is built in the adapter plate and wherein the second and third shuttle valves are built in the valve body of the main valve.

* * * * *